US005575690A

United States Patent [19]

Eaton

[11] Patent Number: 5,575,690

[45] Date of Patent: Nov. 19, 1996

[54] HYBRID MODULAR ELECTRICAL CONNECTOR SYSTEM

[75] Inventor: Larry D. Eaton, Fremont, Calif.

[73] Assignee: TVM, Inc., Fremont, Calif.

[21] Appl. No.: 330,784

[22] Filed: Oct. 28, 1994

[51] Int. Cl.[6] ..... H01R 9/22

[52] U.S. Cl. ..... 439/717; 439/176

[58] Field of Search ..... 439/176, 717, 439/715, 709, 712, 630, 637; 357/74

[56] References Cited

U.S. PATENT DOCUMENTS

| | | | |
|---|---|---|---|
| 3,054,078 | 9/1962 | Baschkin | 339/18 |
| 3,456,231 | 7/1969 | Paullus et al. | 339/60 |
| 3,471,822 | 10/1969 | Van Baelen | 339/18 |
| 4,090,764 | 5/1978 | Malsby et al. | 339/103 M |
| 4,749,357 | 6/1988 | Foley | 439/80 |
| 4,824,380 | 4/1989 | Matthews | 439/176 |
| 5,013,263 | 5/1991 | Gordon et al. | 439/630 |
| 5,024,609 | 6/1991 | Piorunneck | 439/637 |
| 5,055,055 | 10/1991 | Bakker | 439/78 |

*Primary Examiner*—Khiem Nguyen
*Assistant Examiner*—Yong Kim
*Attorney, Agent, or Firm*—Burns, Doane, Swecker & Mathis, L.L.P.

[57] ABSTRACT

A hybrid modular electrical connector system comprised of a family of interlocking modules used to produce custom dedicated, hybrid electrical connectors for power distribution and signal circuit interconnections between printed circuit boards. A dedicated hybrid electrical connector for printed circuit boards can be built up from any number of power connector modules, signal connector modules, spacer modules, and mounting flange modules. With this family of interlocking modules, a custom hybrid electrical connector can be produced with uniform off-the-shelf parts. Once the modules are locked together they form a rigid assembly that functions the same as a unitary molded dedicated connector. In addition only female type modules are produced which can be converted to male type modules by simply inserting electrically conductive adapters into the female modules.

32 Claims, 9 Drawing Sheets

HYBRID MODULAR ELECTRICAL CONNECTOR SYSTEM

BACKGROUND OF THE INVENTION

The present invention relates generally to electrical connector systems for power distribution and signal circuit interconnections between printed circuit boards. More particularly, the invention concerns a hybrid modular connector system in which common, modular, insulating housings that accommodate common, electrically conductive components are interlockable one to another to allow expansion of the electrical connector to any number of power and signal connections as desired.

Generally, there are two types of electrical connectors associated with joining multiple printed circuit boards together (i.e., connecting a mother board to a daughter board). First, power connectors transmit electrical energy between interconnected printed circuit boards. Second, signal connectors transmit operating signals between interconnected printed circuit boards.

In general, off-the-shelf electrical connectors attached to printed circuit boards have been dedicated to operate either solely as power connectors or solely as signal connectors-but not both power connectors and signal connectors in the same connector assembly. Normally, each of these connector types is separately attached to the printed circuit. Independently attaching separate types of connectors thus causes assembly of the printed circuit boards to be costly and time-consuming. Therefore, it is desirable to have both power and signal connectors combined in one rigid, hybrid electrical connector.

Some manufacturers make custom hybrid electrical connectors consisting of both power and signal connections by using a mold that is reducible and expandable. If a user wants two power connections and three signal connections in an electrical connector, the manufacturer expands the mold to produce that configuration and then produces a desired amount of that electrical connector. However, creating the mold is costly therefore a large quantity of electrical connectors must be ordered for the procedure to be cost-effective. Therefore, it would be desirable for a user to be able to produce a small quantity of custom rigid hybrid electrical connectors composed of both signal and power connections.

Modular electrical connector systems, such as U.S. Pat. No. 4,090,764 to Malsby et al., U.S. Pat. No. 3,471,822 to Van Baelen, and U.S. Pat. No. 3,456,231 to Paullus et al., involve connector modules held together by an external frame member or support. Each individual module in the sequence of modules sits beside another module. All modules of the sequence are held in place by the frame member that runs the length of the module sequence. Attaching the modules to the frame member is cumbersome, time-consuming and costly. Therefore, it would be desirable to have a modular connector system in which the individual modules can be locked to each other instead of to a frame member.

SUMMARY OF THE INVENTION

The present invention provides a modular electrical connector system having all the desirable characteristics discussed above while overcoming the deficiencies of the known prior art devices.

In accordance with this invention, a dedicated (i.e., rigid) hybrid electrical connector for printed circuit boards can be assembled from any number of interlocking power connector modules, signal connector modules, spacer modules, and mounting flange modules. With this family of interlocking modules, a custom hybrid electrical connector can be produced with uniform off-the-shelf parts. Once the modules are locked together they form a rigid assembly that functions the same as a unitary molded dedicated connector (i.e., it will not pull apart when the printed circuit boards are connected and disconnected from each other).

In addition, while only female type modules are produced, those female modules can be convened to male type modules by simply inserting electrically conductive gender adapters into the female type modules. In this way, an end user can assemble a custom hybrid electrical connector by deciding which connectors modules should be female and which ones should be male. If only small quantities of the custom hybrid electrical connectors are needed, then the end user can make the desired number out of the interlocking modules. If large quantities of the custom hybrid electrical connector are needed, then the end user may choose to have a dedicated mold made to produce that configuration of the custom hybrid electrical connector. Once an electrical connector has been assembled, it is attached to a printed circuit board. Electrical connectors of one printed circuit board can be mated with electrical connectors on another printed circuit board to join both power supplies and signals.

In accordance with one embodiment of the invention, a modular connector system for printed circuit boards is provided having a first modular connector, such as a power connector, and a second modular connector, such as a signal connector, each having a complementary locking element on one side so that the connectors can be permanently interlocked together to form a rigid hybrid electrical connector when the complementary locking elements are joined. Each module may also include a complementary locking element on an opposite side thereof so that any number of modular connectors can be permanently interlocked together to form a desired hybrid electrical connector configuration.

In accordance with other aspects of the invention, modular spacers having complementary locking elements may be joined with other modules to create a desired incremental spacing between the first and second modular connectors. Flange mounting end modules may also be provided, each having a complementary locking element to lock onto corresponding ends of the rigid hybrid electrical connector assembly so that the hybrid connector can be attached to a printed circuit board with mechanical fasteners which may also serve to house guide pins to ensure alignment during mating.

In accordance with a further aspect of the invention, gender conversion elements convert the modular female type connectors to male type connectors. The gender conversion dement for the female type power connectors may be different from the gender conversion element for the female type signal connectors.

To accommodate the need for both endwise and perpendicular connections between printed circuit boards, modular connectors with mating orientations parallel to the surface plane of a printed circuit board and modular connectors with mating orientations perpendicular to the surface plane of a printed circuit board are contemplated as well as a combination of both. Thus, printed circuit boards can be connected end-to-end, perpendicularly, in parallel or a three-dimensional junction, depending on the modules selected.

In one of its method aspects, the invention provides a method for assembling an electrical connector by permanently interlocking modular connectors, such as modular power connectors and modular signal connectors. In another method aspect, the interlocking step includes attaching spacer modules and mounting flange modules to the electrical connector to achieve desired spacing between the modules and to provide a mechanical attachment arrangement between the electrical connector and a printed circuit board.

BRIEF DESCRIPTION OF THE DRAWINGS

Many objects and advantages of the present invention will be apparent to those skilled in the art when this specification is read in conjunction with the attached drawings wherein like reference numerals are applied to like elements and wherein.

DETAILED DESCRIPTION OF THE PREFERRED EMBODIMENTS

Figure 1:
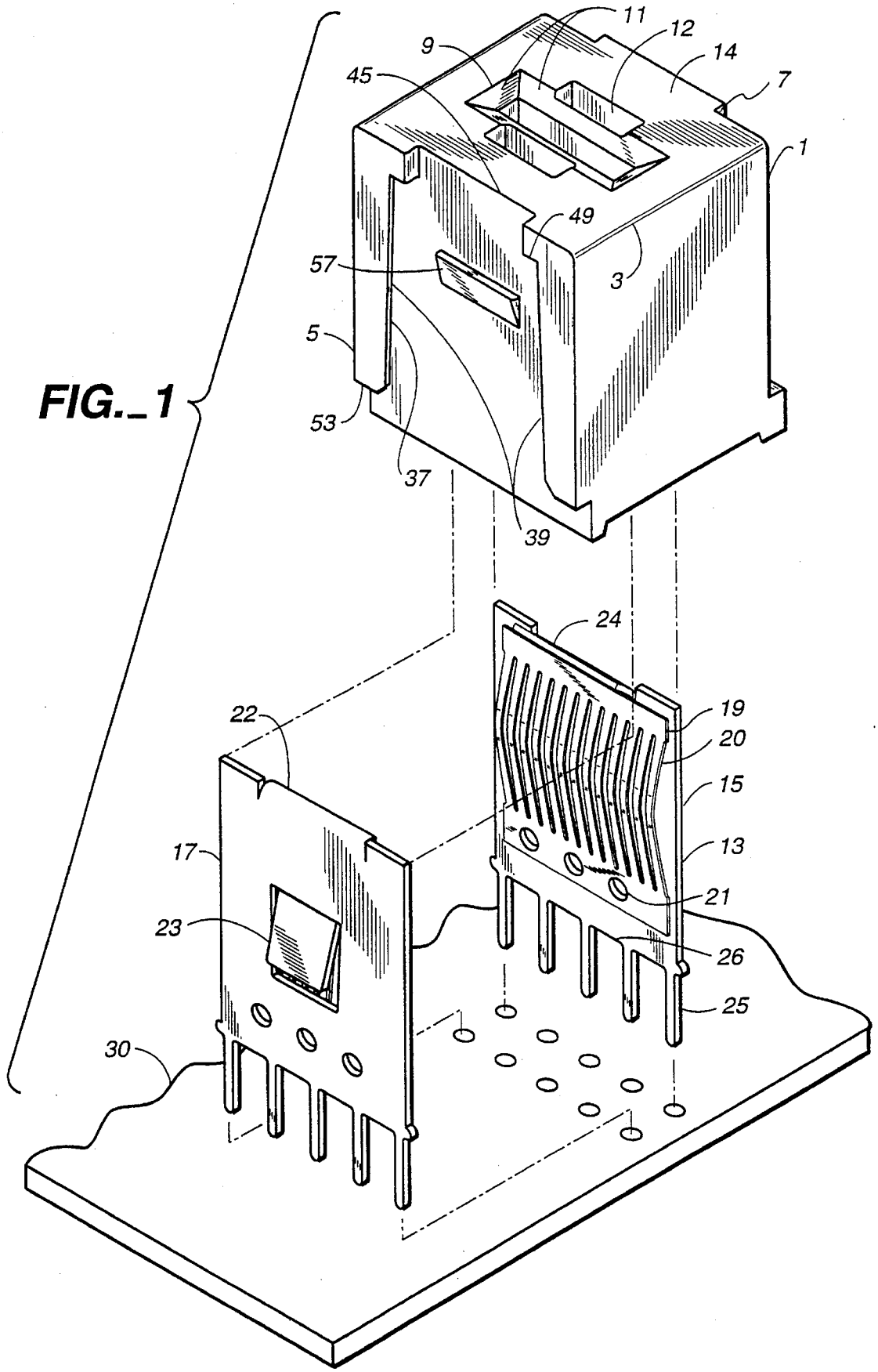
FIG. 1 is an exploded perspective view of a female modular power connector for perpendicular connection.

The present invention concerns a family of off-the-shelf interlocking modules used to produce custom hybrid electrical connectors for power distribution and/or signal circuit junctions between printed circuit boards. The family of modules includes power connector modules, signal connector modules, spacer modules, and flange-mounting modules. Moreover, the power connector modules and the signal connector modules for both parallel and perpendicular junctions are provided.

A modular power connector 1 (see FIG. 1 ) is one member of such a module family. The modular power connector 1 generally includes (i) an insulating housing 3 having a female locking element 5 on one side and a male locking element 7 on the opposite side and (ii) an electrically conductive body 13. This module is adapted for effecting connection perpendicular to the plane of the printed circuit board 30. To facilitate such a perpendicular connection, the modular power connector 1 has a centrally positioned, generally rectangular opening 9 in its top surface 14 for receiving a mating male connector element. In the plane of the top surface 14 (FIG. 2), the opening has a length and a width transverse to the length. The width of the opening 9 is selected to be larger than the predetermined thickness of a mating male connector element; the length of the opening is selected to be greater than the width of the mating male connector element.

To guide the mating male connector contact toward the opening 9 (FIG. 1 ) and facilitate access to that opening 9, four inclined or tapered side cam surfaces 11 slope inwardly from the top surface 14 to the peripheral edge of the opening 9. The cam surfaces 11 are inclined with respect to the longitudinal axis of the housing 3 by an angle θ (see FIG. 3) which is less than 45°, measured from the line perpendicular to the top surface 14. In particular, the angle of the inclined side surfaces is selected so that those surfaces function as cam surfaces to guide the male mating connector element into the opening 9 without friction locking.

The housing 3 is preferably fabricated using flame retardant plastic, but any suitable insulating material may be used. It is important that the housing material be an electrical insulator in order to reduce the possibility of electrical shock hazard.

The insulating housing 3 has an internal cavity 8 (FIG. 3) sized and configured to receive, retain, and substantially surround an electrically conductive body 13. The internal cavity 8 is open to the bottom 16 of the insulating housing 3 and extends through the insulating housing 3 so as to communicate with the opening 9. The length along the edge of the internal cavity 8 is at least as long as the length of the opening 9 so that a mating male connector element can pass through the opening 9 and be received in the internal cavity 8. Moreover, the width across the cavity 8 exceeds the width across the opening 9 so that a male mating connector element can be received in the electrically conductive body 13, which is also received by the cavity 8.

Each side of the internal cavity 8 may include a means for receiving and retaining a locking protrusion 23 of the electrically conductive body 13. For example, a latch channel or slot 10 may be provided which extends away from the internal cavity 8 into the insulating housing 3. Each slot 10 may open at one end into a corresponding cam surface 11 at the top surface 14 of the insulating housing 3 and terminate internally in the housing with an abutment surface 25. In cross-section, each of the slots 10 may be generally rectangular. By extending the slot 10 to the inclined surface 11 at the end of the insulating housing 3, access is provided for a latch release tool (not shown) in the event that the locking tab 23 must be dislodged from the abutment surface 25 so that the housing 3 can be separated from the electrically conductive body 13.

The electrically conductive body 13 is received in the cavity 8 from the bottom 16 of the insulating housing 3. The electrically conductive body 13 has two opposing, generally planar sides 15, 17 (FIG. 1). It is contemplated that the two opposing sides 15, 17 may be electrically connected at one or both ends, for example, by connecting the opposing sides with one or more electrically conductive bars. Each planar side 15, 17 has a corresponding edge 24, 22 adjacent to the opening 9. In general, the two opposing sides 15, 17 are spaced from one another by a distance which is greater than the width across the opening 9 and greater than the thickness of a mating male connector element. The edge 22, 24 of each side adjacent to the opening 9 is preferably curved in the direction normal to the surface 14 toward the opposed side so that the edges 22, 24 are engaged by the mating male connector element and spread apart during connection therewith. To assure electrical contact with the mating male connector element, these edges 22, 24 (FIG. 3) are spaced by a distance smaller than the width of the opening 9, and smaller than the thickness of the male connector element.

While the curvature of the upper edges 22, 24 shown in FIG. 1 is a simple bend, the curvature could be more complex and still be within the scope of this invention. For example, the upper edge portion could be formed to provide an inwardly directed convex protrusion as an alternative to the simple bend illustrated in FIG. 1.

The electrically conductive body 13 is preferably fabricated of high conductivity, oxygen-free copper, but it is contemplated that other high conductivity metals such as beryllium-copper, aluminum, steel, or any other conductive material suitable to the operating conditions, can be used. The electrically conductive body 13 preferably has some spring-like resiliency so that the edges 22, 24 can move apart to receive the male connector therebetween.

At least one side 15, 17, and preferably both sides, of the electrically conductive body 13 has a locking protrusion 23 for securing the electrically conductive body 13 in the insulating housing 3. For example, each side 15, 17 may include the protrusion or tab 23 extending outwardly away from the conductive body and arranged so that the end of the protrusion is oriented toward the bottom 25 of the insulating housing 3. Each locking tab 23 (FIG. 1) is preferably centrally positioned between longitudinal edges of the corresponding side 15, 17. Moreover, each locking tab 23 is shaped and positioned such that the tab can be received in a corresponding slot 10 of the insulating housing 3 (FIG. 3). For simplicity, the locking tabs 23 of each side 15, 17 are preferably identical; however, it is within the scope of this invention that those tabs may have different shapes and/or proportions, if desired. The important attribute of the latching tabs 23 is that their fore-shortened shape, as viewed from the top surface 14 (FIG.2), conforms to the cross-sectional shape of the slots 10.

As seen most clearly from FIG. 1, the side edges of the sides 15, 17 are straight and substantially parallel. Sides of the cavity 8 (FIG. 3) within the housing 3 have grooves from the bottom surface 16 to the location of the opening 9, which grooves receive those side edges. When the housing 3 (FIG. 3) slides over the electrically conductive body 13, the side edges slide into the corresponding grooves until the upper edges 22, 24 move into parallel relationship with the long sides of the opening 9. Moreover, during this assembly the latch tabs 23 are resiliently pressed into the plane of the corresponding sides 15, 17. However, when the electrically conductive body 13 reaches the predetermined location in the housing, the latch tabs 23 resiliently spring outwardly into the corresponding slots 10. Engagement between the ends of the tabs 23 and the abutments 25 prevents the electrically conductive body 13 from being dislodged from the housing 3.

Extending from the bottom edge 26 of the electrically conductive body 13 are a plurality of contact terminals 25 for attachment to a printed circuit on a printed circuit board 30 (not seen in FIG. 3). These contact terminals 25 can be any one of a variety of contact configurations, including, but not limited to, conventional solder tails, screw terminals, crimps, "fast on" tabs or conventional compliant press pins. Although not limited to just these configurations. It is further contemplated that the contact terminals may be straight (FIG. 1 ) so as to have a common 3.0 mm wide pattern or be gull-wing shaped (FIG. 3) so as to have a common 8.0 mm wide pattern.

Each side 15, 17 of the electrically conductive body 13 may be provided with a resilient spring-contact element 19 (FIG. 1 ) having a plurality of parallel, resilient, spring contacts 20, each of which extends longitudinally in the housing 3 relative to the opening 9. The spring contacts 20 may be integrally connected in a band-like element 19. One edge of the resilient spring-contact element 19 is attached to the corresponding side 15, 17 of the conductive body 13. One method of attachment is to make circular punches 21 that are swaged to fasten the resilient spring-contact element 19 to the corresponding side 15, 17. The parallel edge of the spring-contact element 19 (closest to the inwardly curved edge 22, 24) is then free to move in the plane of the side 15, 17. As a result, the spring contacts 20 can flex with reduced stress compared to mounting arrangements where both parallel edges of the spring-contact element 19 are fastened. Such reduced stress increases the useful life of the contact elements 20 by reducing the frequency of breakage. If desired, the central portion of each spring contact 20 can be coated with gold or another oxide/corrosion resistant material to improve the electrical contact with the spring contacts 20.

The staked method of attachment is, of course, only one technique for effecting attachment of the spring contact element 19 to the corresponding side 15, 17. For example, a plurality of tabs (not shown) in each side 15, 17 can be used to position and attach the resilient spring contact element 19. Each tab may be integral with the material of the conductive body 13 and may be generally rectangular in shape. The tabs may be arranged in one or two rows spaced to correspond to the width of the resilient spring-contact element 19, with the tabs presenting an opening accessible from the desired position of the resilient spring-contact element 19. When the spring-contact element 19 is positioned under the tabs, the tabs can be pressed down into engagement with the edges of the spring-contact element 19 to secure it in position and in electrical contact with the corresponding side 15, 17. Other means can be used to hold the resilient spring contact element 19 in place such as punched holes, spot welds or integral rivets, etc.

Each end of each spring contact 20 has an increased width portion adjacent to its integral junction with the spring-contact element 19. The reduced width portion at the center of each contact element 20 is more easily deflected when the contact engages a cooperating male-type connector element and is resiliently biased toward a contact position.

When the spring-contact element 19 is attached to the corresponding side 15, 17 of the conductive body 13, the spring contacts 20 protrude farther toward the center of the cavity 8 than does the end 22, 24 of the corresponding side 15, 17 (FIG. 3). The resilient spring contacts 20 provide the electrical connection between the modular power connector 1 and a mating power connector element. The spring contact-element 19 is preferably fabricated from heat-treatable grade beryllium-copper, but it may be composed of other electrically conductive metals such as beryllium-nickel alloys, copper-nickel, copper-iron, phosphor-bronze, stainless steel, etc. depending on desired cost or service conditions encountered.

The use of a multiplicity of resilient spring contacts 20 is advantageous because the large number of contacts accommodates higher amperage connections having improved electrical conductivity, lower voltage drop, and less power consumption in the system.

As discussed above, each forward edge 22, 24 of the sides 15, 17 is curved inwardly toward the opening 9 (FIG. 3) as shown thereby facilitating "hot plugging." "Hot plugging" is the assembly of a male power connector with a mating female modular power connector while an electrical potential exists between the male connector and the electrically conductive body 13 of the female modular power connector. This electrical potential can result in arcing between the male connector element and the first electrically conductive member to approach it. Such arcing can erode, melt, or otherwise damage the thin, foil, resilient-contact dement 19 thereby reducing the performance of the modular power connector. By establishing the spacing between the curved ends 22, 24 to be less than the thickness of the mating male connector element, initial electrical contact will occur between the mating male connector and the comparatively thick curved ends, rather than the thin, foil contacts 20. Heavier material thickness of the two sides 15, 17 can accommodate the initial power surges without damage. Nevertheless, as the male connector element moves farther into the internal cavity 8 of the mating female connector module, the male connector element engages the resilient spring contacts 20—but without an electrical potential therebetween so that the possibility of arcing is substantially avoided.

In operation, as a male connector element (FIG. 3) moves into near contact with the curved ends 22, 24 of the mating female connector module, the initial arc is absorbed by the curved ends 22, 24. Then the mating connector element can be pushed farther into the internal cavity 8 of the modular power connector. In other words, the curved ends 22, 24 operate essentially as a switch. The curved ends 22, 24 absorb the initial are and operate to close the circuit. In this way, the curved ends 22, 24 preclude electrical arcing between the male connector element and the thin, foil, resilient spring-contact element 19, essentially preventing damage to the spring member. Only after an electrical connection has been established between the male connector element and the electrically conductive body 13 of the mating female connector through curved ends 22, 24 (eliminating the arc-producing electrical potential), does the male connector element approach the resilient spring-contact element 19 and the thin, foil, resilient spring contacts 20.

As noted, when the electrically conductive body 13 is positioned in the housing 3 (FIG. 3), edges of the sides 15, 17 are received in corresponding guide slots in the housing 3. That edgewise connection cooperates to restrict lateral displacement of the sides 15, 17 when a male-type element is introduced between the sides 15, 17. By virtue of the assembly arrangement, the curved ends 22, 24 are cantilever mounted from the sides 15, 17, and are initially constrained to the predetermined spacing discussed above. The insulating housing 3 thus prevents permanent deformation of the electrically conductive body 13. In other words, the insulating housing 3 prevents the opposing sides 15, 17 from permanently separating or spreading apart after multiple uses of the modular power connector.

The modular power connector 1 in FIG. 1 is a perpendicular-mount power connector. The connector is referred to as perpendicular mount because a male connector element inserted in opening 9 in the top surface 14 would have a mating orientation that is perpendicular to the surface of the printed circuit board 30. In another embodiment, the modular power connector 1' (FIG. 4) may permit a mating male connector element to be oriented parallel to the surface of the printed circuit board. In this arrangement, the opening 9' of the power connector is located in a side surface of the housing 3.

Figure 5:
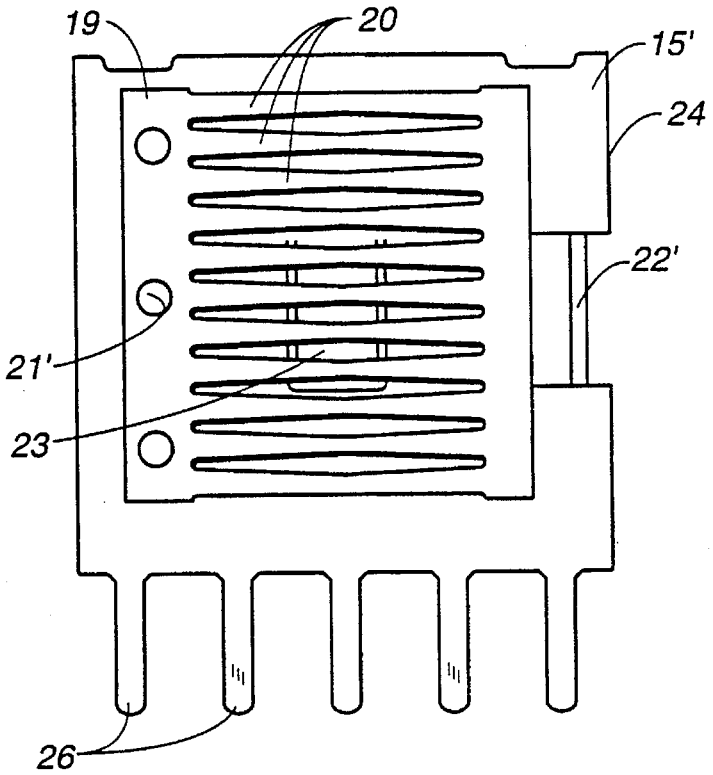
FIG. 5 is a elevational view of the electrical connector assembly for FIG. 4.

Since the mating male-type element connects with this module from the side, the internal electrically conductive body has a modified design. More particularly, the spring contacts 20 (FIG. 5) of the resilient spring-contact element 19 are arranged so that the longitudinal extent of the contacts 20 are generally horizontal and in alignment with the side opening. The side of the element 19 remote from the opening may be swaged 21' to the side 15' of the electrically conductive body as described above. Alternatively, tabs could be used to effect the connection in the manner described above. The vertical side edge 24 of the side 15' has a central portion 22' curved inwardly to provide the "hot plugging" contact. Extending from the bottom edge of the side 15' are a plurality of pins 26 displaying one or several methods for connection with a circuit board. An integral latching tab 23 is provided in the side 15' for engagement in a latch channel as described more fully above. Moreover, the vertical edges of the side 15' are received by corresponding grooves in the sides of the housing 3 to mechanically support the electrically conductive body.

In other material respects, the modular power connector 1' (FIG. 4) operates essentially the same as the modular power connector 1 discussed above in connection with FIGS. 1 and 3.

Figure 6:
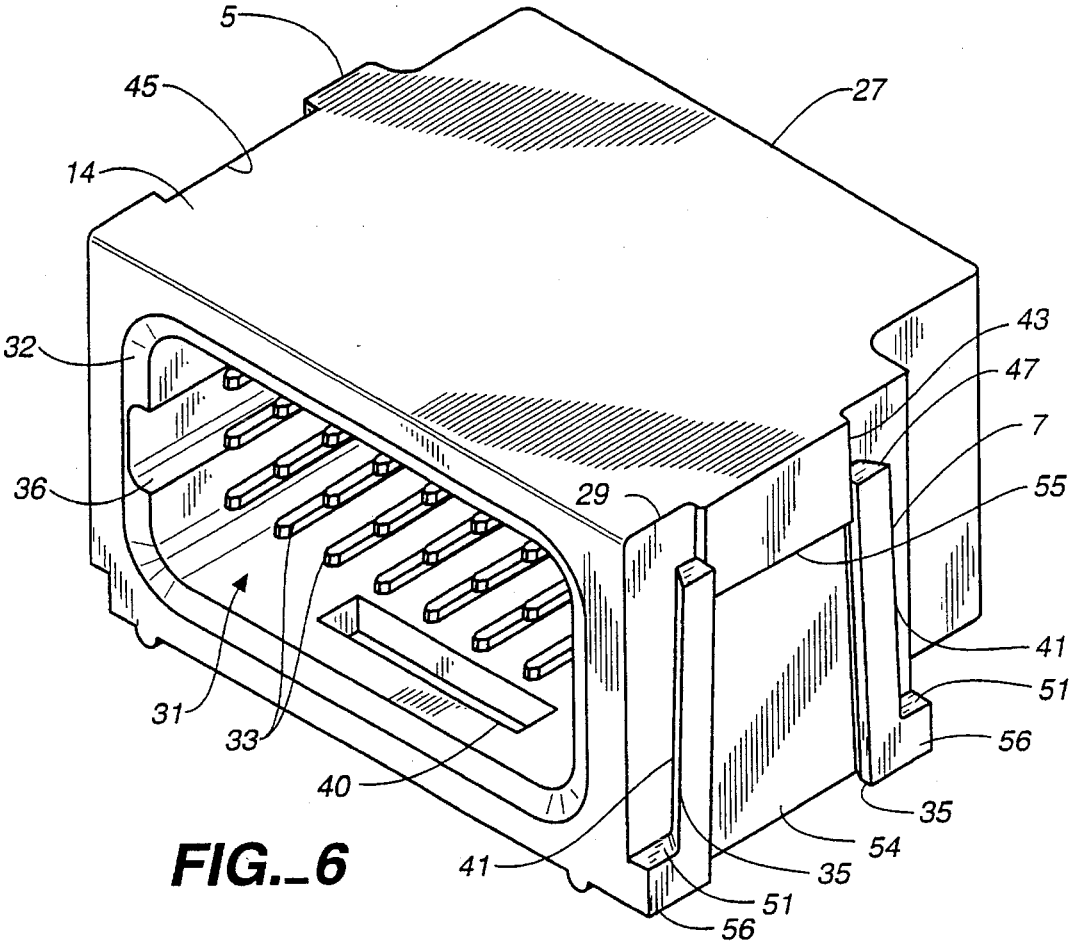
FIG. 6 is a perspective view of a female modular signal connector for parallel connection.
Figure 7:
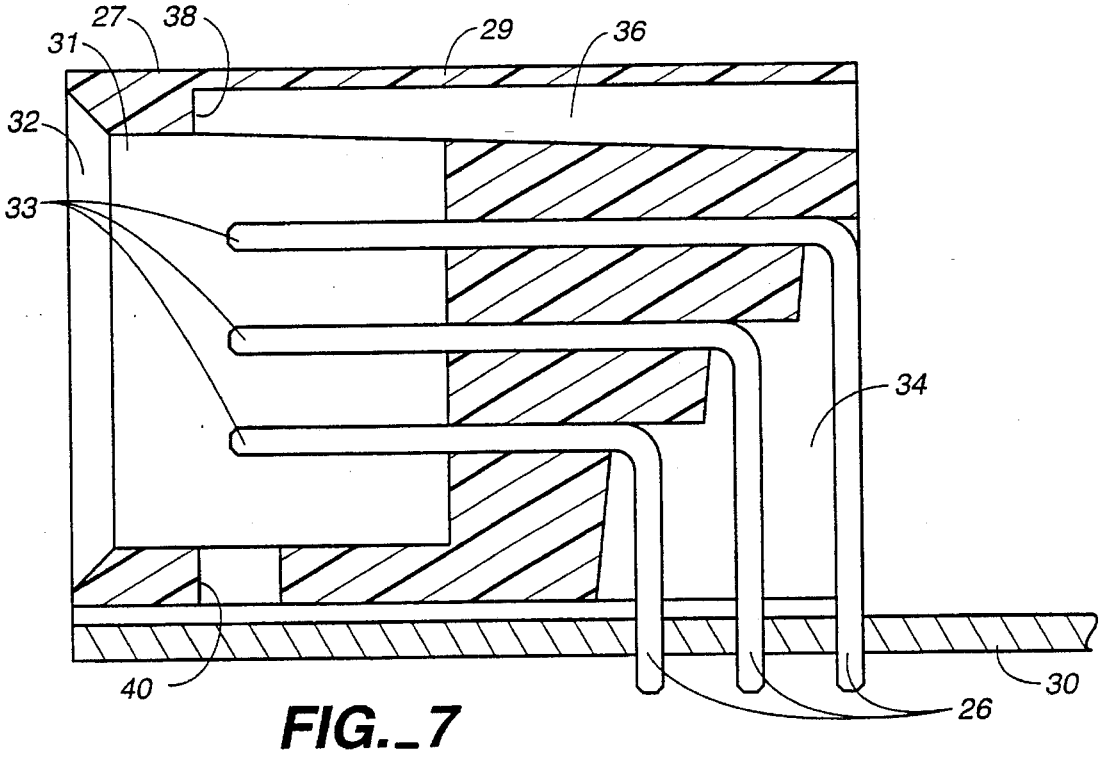
FIG. 7 is a cross-sectional view of the female signal connector of FIG. 6.

Another member of the family of interlocking modules is a signal connector module 27 (see FIG. 6). In a parallel-mount embodiment, the signal connector 27 includes an insulating housing 29 defining a large opening or signal connector socket 31. The socket 31 has a lead-in or chamfered edge 32. The lead-in functions as a cam surface to guide a mating male connector element into the socket 31 without friction locking. The socket 31 can have a keyway 36 or some particular geometric shape to help ensure a proper connecting orientation of a mating male connector element. The socket 31 surrounds a plurality of electrically conductive contact pins 33, each of which is electrically connected with a corresponding contact terminal 26 (FIG. 7). Preferably, the contact pins 33 are arranged in vertical groups so that the contact terminals 26 can be bent in a vertical plane and define laterally spaced connection points on the printed circuit board 30. Moreover, this arrangement permits a vertical partition 34 in the housing to space and insulate vertical groups of contact pins 33 from one another. In use, the contact terminals 26 may be attached to a printed circuit on a printed circuit board 30. Moreover, the contact terminals 26 can be any one of a variety of contacts configurations, including for example solder tail or compliant press pins. There may be any number of contact pins 33 to provide desired signals to a printed circuit through the associated contact terminals 26.

Internally, the upper portion of the housing 27 also includes an elongated latch channel 36 extending from the back of the housing, to a side of the socket 31, and terminating in an abutment surface 38. At the bottom, the housing 27 includes a lateral latch opening 40' the forward edge of which is aligned with the abutment surface 38 of the upper channel. The latch opening 70 and the channel 36 have comparable widths in the socket 31. As seen in FIG. 6, these openings may extend across a substantial portion of the width of the socket 31.

In another embodiment (FIG. 8), a perpendicular-mount signal connector 27' has the same elements as the parallel-mount signal connector 27 described above in connection with FIG. 6. The principal difference being that the perpendicular-mount connector 27' (FIG. 8) has the socket 31' in the top surface of the connector housing. Thus the socket 31' opens perpendicularly to the plane of the printed circuit board to which it may be attached, as contrasted to the signal connector socket 31 (FIG. 6) which opens parallel to the plane of the printed circuit board. Another difference is that the contact pins 33 extend straight through (FIG. 12) the bottom of the housing 27' to engage the printed circuit board. Keyways for polarization and latching abutments may also be provided in this configuration.

Figure 8:
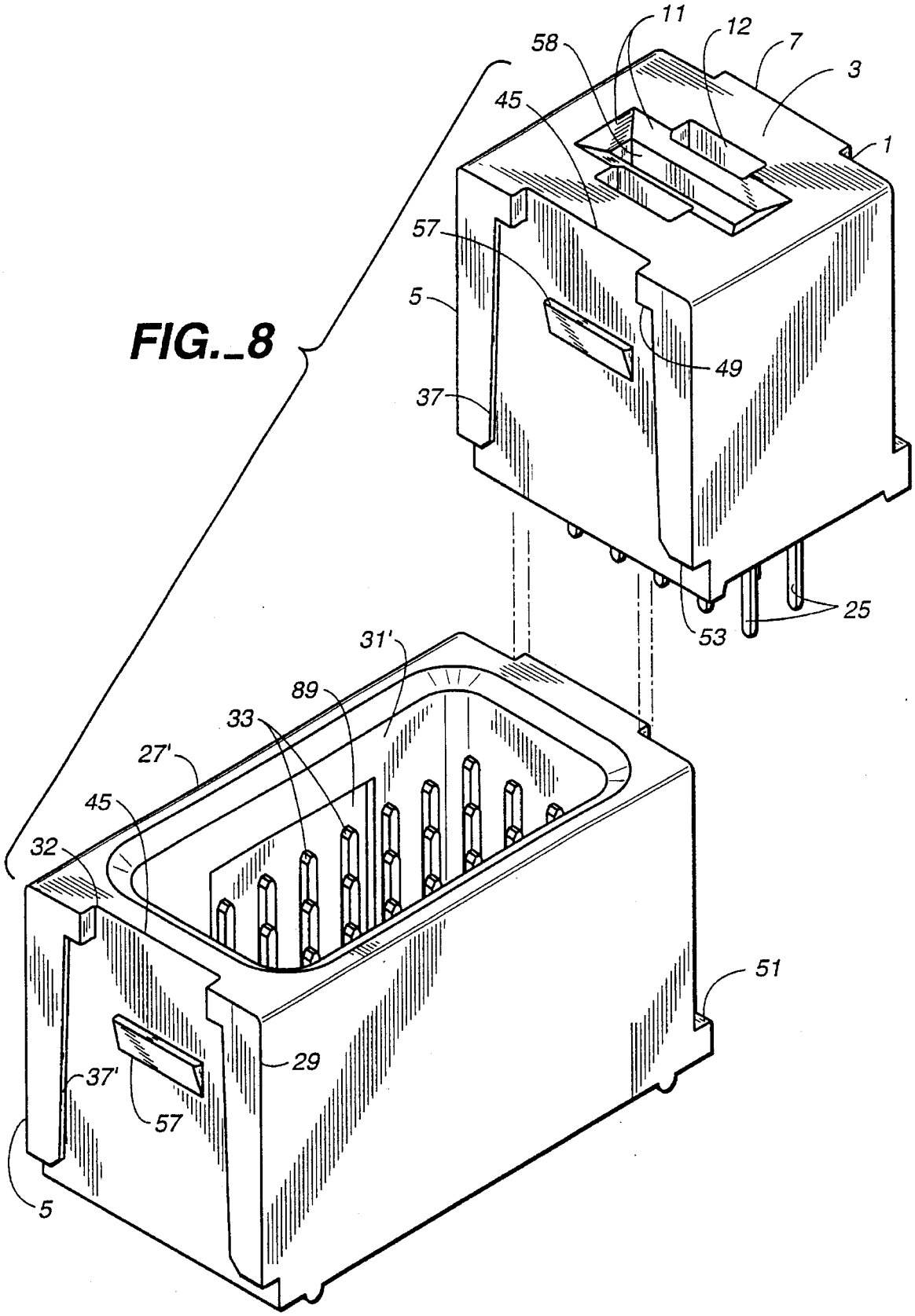
FIG. 8 is a perspective view of a female modular power connector and a female modular signal connector just prior to interlocking assembly, both modules being for perpendicular connection.
Figure 9:
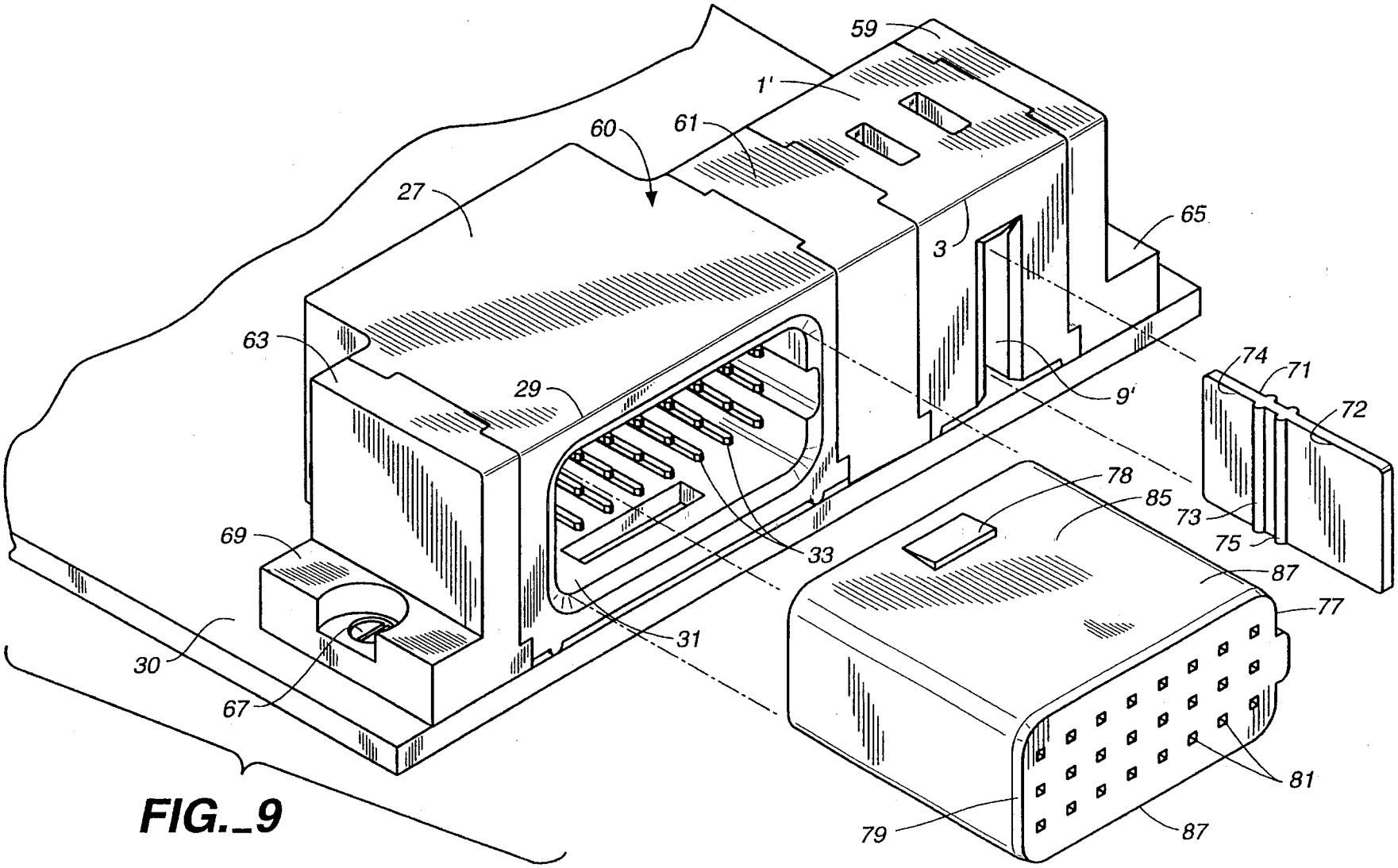
FIG. 9 is a perspective view of a hybrid assembly of interlocked end modules, a signal connector module, a spacer module, and a power connector module.

FIG. 9 shows an embodiment of a rigid hybrid electrical connector 60 including various interlocking modules of the present invention. A parallel-mount power connector module 1' and parallel-mount signal connector module 27 are shown merely as one embodiment. The perpendicular-mount versions as shown in FIG. 8 are also part of the present invention and can be used in addition to, in conjunction with, or in place of, the modules depicted in FIG. 9. Besides the power connector module 1' and signal connector module 27, the electrical connector 60 has a right-end mounting-flange module 59, a spacer module 61 between the power connector module 1' and the signal connector module 27, and a left-end mounting-flange module 63.

The right-end mounting-flange module 59 has a base 65 with an opening (not shown) for receiving a threaded fastener 67. The right-end mounting-flange module 59 has the same female locking element 5 (FIG. 4) as the other modules so that it can be interlocked with any one of the other modules. The spacer module 61 (FIG. 9 ) has both a female locking element 5 and a male locking element 7 so that it can be interlocked between other modules. The spacer module 61 allows the physical spacing between adjacent modules to be incrementally increased. The left-end mounting-flange module 63 has the same male locking element 7 (FIG. 6) as the other modules so that it, too, can be interlocked with any one of the other modules. The left-end mounting-flange module 63 (FIG. 9 ) has a base 69 with an opening for receiving a threaded fastener 67. While the fastener 67 is shown as a screw, one of ordinary skill in the art will readily appreciate that any one of a variety of fasteners can be used, such as rivets, pins, adhesives, etc. It is contemplated that any number of the family of interlocking connector modules, spacers, and flange modules can be interlocked to form an electrical connector 60 tailored to meet the needs of the end user.

Each interlocking module of the present invention includes a female locking element 5 (FIG. 4) on one side and a male locking element 7 (FIG. 6) on the opposite side. The female locking element 5 is substantially identical on each of the modules. Likewise, the male locking element 7 is substantially identical on each of the modules. With this configuration, any number of modules can be interlocked together as shown in FIG. 8 to obtain a desired linear sequence of modules as seen in FIG. 9. It should be noted that the linear sequence of modules in FIG. 9 is shown for illustrative purposes only, any combination of power connector modules, signal connector modules, spacer modules, and end flange modules can be selected, as may be required for a particular application, including an array of modules connecting in multiple perpendicular axes. For example, an array could comprise a parallel-mount power connector module, a perpendicular-mount signal connector module, a parallel-mount signal connector, and a perpendicular-mount power connector or any number of combinations.

The female locking element 5 (FIG. 4) is located on one side face 44 of the housing 1', for example. Extending along each vertical edge 46 of that side face 44, from the top face 14 toward the bottom, is an L-shaped projection 48 terminating in a lower shoulder 53. These L-shaped projections 48 are symmetrically positioned on the side face 44. At the top edge of that side face 44, the L-shaped projections are spaced from one another and define a notch 45. Near the top edge, and adjacent to the notch 45, the L-shaped projections each define an upper stop 49. The elongated portion of each L-shaped projection has an inner face 50 extending from the lower shoulder 53 to the upper stop 49. Each inner face 50 is inclined relative to the axis of symmetry of the face 44 at an angle of about 2°, the inclinations of the two faces 50 being convergent toward the top surface 14. Moreover, each inner face 50 of the two L-shaped projections 48 facing the axis of symmetry is undercut so that (see FIG.2), at the side surface 44, the distance between the inner faces 50 is greater than the corresponding distance between the projections taken at a parallel location above the side surface 44. Thus, the long legs (FIG. 4) of the L-shaped projections 48 define guide slots 37. In the center of the notch 45, spaced at a predetermined distance from the top edge, is a ledge 57 that extends transversely between the L-shaped projections. The ledge projects from the surface 44 by a distance about one-half of the depth of the notch 45 in the plane of the top 14.

On the opposite side face of the housing 1' is a male locking element 7. As each of the locking elements 5, 7 is identical, the male locking element 7 of FIG. 6 can be described, it being understood that the description is genetic to each of the modular connectors. Symmetrically positioned on the side face 54 are a pair of L-shaped projections 56 having their short legs extending outwardly at the bottom of the housing and defining lower stops 51 thereon. The upper ends of the L-shaped projections define upper shoulders 47 spaced below the top 14 of the housing 27. Between the L-shaped projections 56 at the top of the housing is an outwardly projecting guide block 43 having a width corresponding to the width of the notch 45 (FIG. 4) and a length slightly less than the predetermined distance between the ledge 57 and the top 14 of the housing 3'. This guide block 43 projects outwardly from the side 54 by a distance of approximately 75% of the depth of the notch 45. With that arrangement, there is an interference fit between the guide block 43 and the abutment 57 during assembly of adjacent modules.

The long legs of the L-shaped projections 56 define a pair of guide rails 35. These guide rails 35 are inclined relative to the axis of symmetry for the face 54 by a 2° angle, the guide mils 35 being convergent toward the top surface 14. The value of this angle is selected to conform to the corresponding angle of the guide slots 37. The side surface 41 of each guide rail 35 facing the housing edge is undercut to conform to the shape of the guide slots 37 (see FIG.2).

Figure 2:
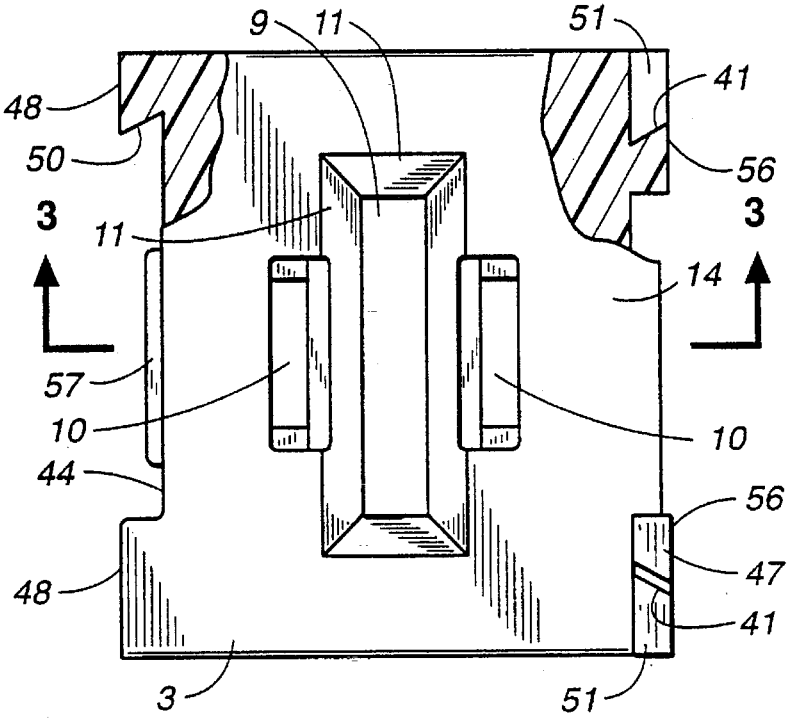
FIG. 2 is a top view of the modular power connector of FIG. 1 with portions shown in cross section.
Figure 3:
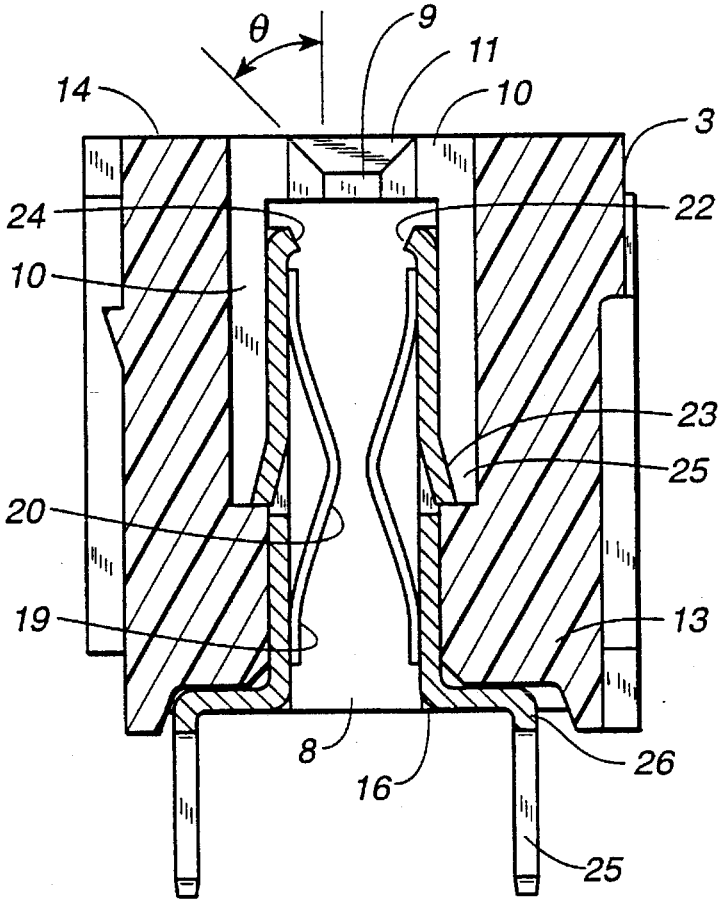
FIG. 3 is a cross-sectional view of the modular power connector taken along line 3—3 of FIG. 2.
Figure 4:
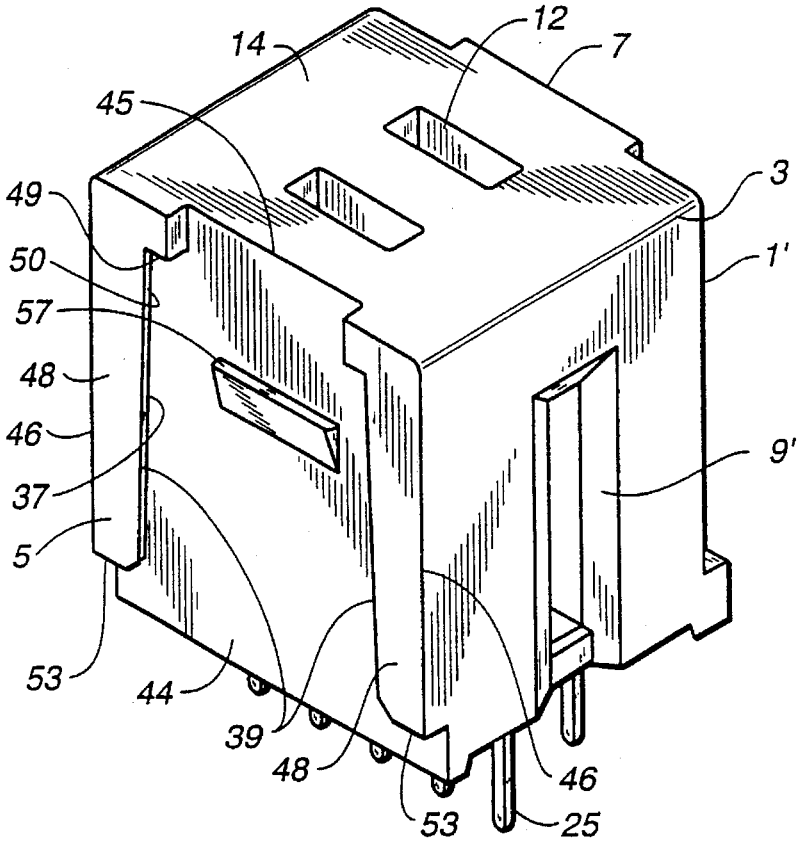
FIG. 4 is a perspective view of a female modular power connector for parallel connection.

The interlocking connection of female locking element 5 with male locking element 7 will be more easily understood with reference to FIGS. 2, 4 and 6. To connect two modules, the female locking element 5 of a first module is positioned vertically above the male locking element 7 of the second module. Then, the first module is pressed down onto the second module such that the female locking element 5 and the male locking element 7 engage one another. The guide mils 35 (FIG. 6) of the male locking element 7 are slidably received behind the guide slots 37 (FIG. 4) in the female locking element 5. Then the guide block 43 slides into the notch 45 until the upper shoulders 47 abut the upper stops 49 and the lower stops 51 abut the lower shoulders 53. The surfaces 39 of the female locking element 5 and the surfaces 41 of the male locking element 7 are further dovetailed to form a locking wedge between the surfaces. In addition, the outer edge of the surface 57 on the female locking element 5 has an interference relationship with the guide block 43 of the male locking element 7. Accordingly, when the first module is fully engaged by the second module, the abutment surface 57 projects under the guide block 57 preventing disassembly of the two modules.

The locking elements illustrated in the drawings are dove-tail connections but as will be appreciated by one of ordinary skill in the an any one of a number of different connections can be used, such as but not limited to, adhesives, ultrasonic welds, snap-fits, and tongue-in-groove connections.

A range of angles for the convergent guide surfaces 37 and guide rails 41 could be used from 0.1 degree to 10 degrees, preferably between 1 degree and 7 degrees, and most preferably 2 degrees. Moreover, the surfaces 41, 50 (FIG.2) are preferably inclined at an angle of about 30° to a line perpendicular to the associated side surface.

Figure 10:
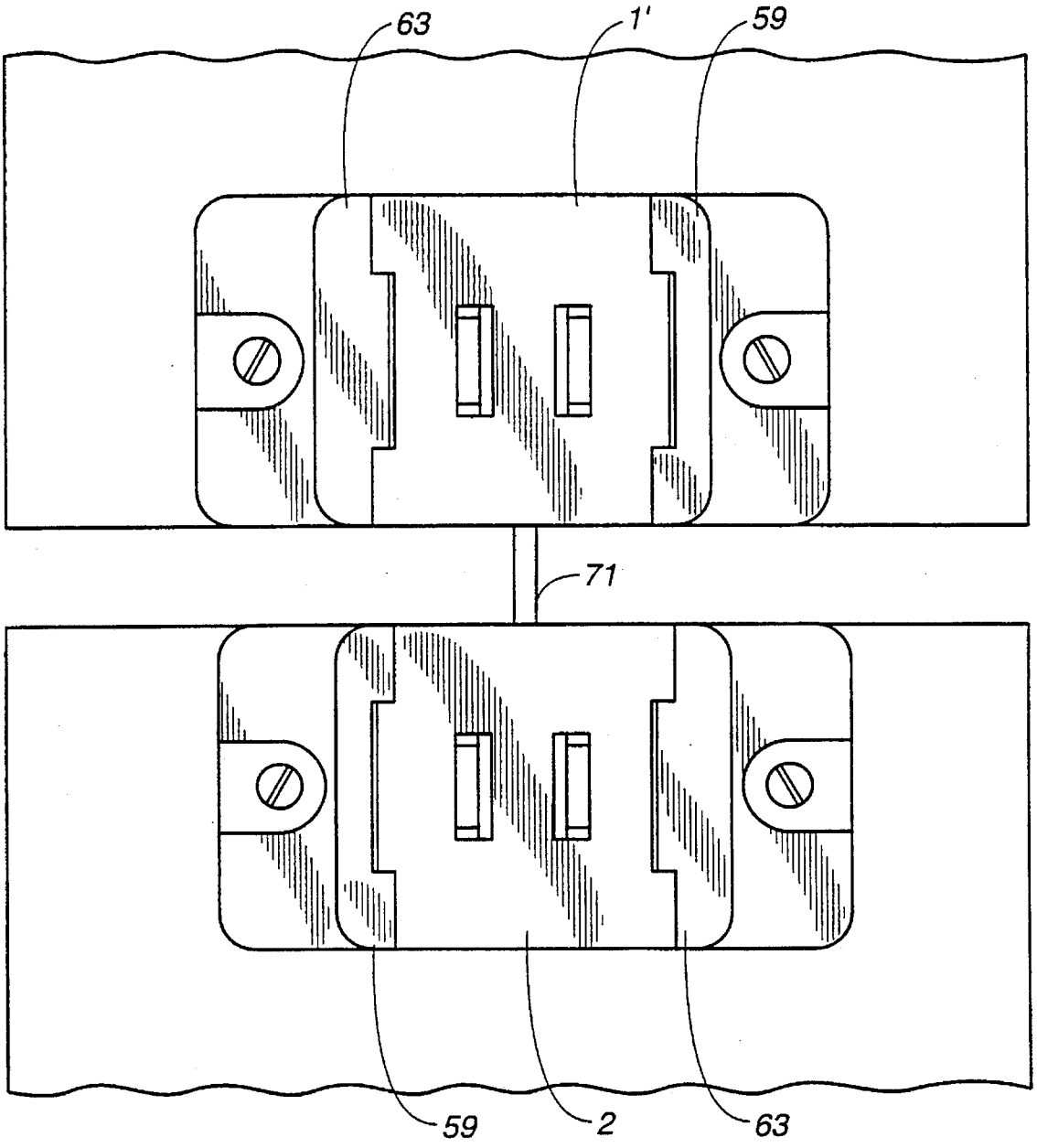
FIG. 10 is a plan view of two parallel-type power connector modules mated together.

The power connector module 1 (FIG. 1 ) and the power connector module 1' (FIG. 9 ) can be converted from a female type connector to a male type connector by inserting one end 74 of a gender changing element 71 into the opening 9'. More particularly, for the power connector module 1', the electrically-conductive, gender-changing contact element 71 has a predetermined thickness and a predetermined width. The other end 72 of the gender changing element 71 extends out of the power connector 1' to define a mating male power connector module that is matable with female type power connector 2 (for example as shown in FIG. 10).

The electrically conductive contact element 71 (FIG. 9 ) has a two sets of laterally extending protrusions 73, 75. The first set of protrusions 73 is configured to deflect the edges 22, 24 (see FIG. 3) of the conducting body 13 inside the opening 9' (FIG. 9) just enough to allow the first set of protrusions 73 to pass through. Then, after the first set of protrusions 73 pass the opening 9', the first set of protrusions 73 are lockingly retained in the insulating housing 3. The second set of protrusions 75 is larger than the first set of protrusions 73 (i.e., projects farther away from side surfaces of the element 71) and is operable to prevent the electrically conductive contact element 71 from being inserted too far into the power connector module 1'. Once the electrically conductive contact element 71 is inserted in the power connector 1' it cannot be removed. In this way, the power connector 1' is converted from female gender to male gender. Moreover, when the power connector 1' is mated with another power connector 2, and then subsequently disconnected, the contact element 71 will be retained in the male power connector.

The contact element 71 is preferably fabricated of high conductivity, oxygen-free copper, but it is contemplated that other generally conductive metals such as beryllium-copper, aluminum, steel, etc. can be used. The contact dement 71 may be a stamped part with the protrusions 73 being locking tabs similar to the locking protrusions 23 (see FIG. 1 ) on the electrically conductive body 13. Alternatively, the end 74 of the contact element 71 may be extended so that it extends through the cavity 8, out through the back of the insulating housing between the contact terminals 25, where an AC input line can be attached so that AC current does not have to be brought through the printed circuit board.

The perpendicular mounting modular power connector 1 can be converted from a female type connector to a male type connector in the same way as just described. In addition, the end 74 of the contact element 71 may extend through the cavity 8, out through the bottom of the insulating housing between the contact terminals 25, and through a slot in a printed circuit board (on which the perpendicular mounting modular power connector is mounted) where an AC input line can be attached.

Both the parallel-mount and perpendicular-mount signal connector modules 27 can be also converted from a female type connector to a male type connector by inserting a gender changing contact adaptor 77 (see FIG. 9 ). The contact adaptor 77 in inserted into the socket 31 and has outwardly projecting latches 78 on the top as well as the bottom surfaces. Moreover, the adaptor 77 has female pin-receptors 81 on both ends, which are connected in pairs (FIG. 11 ) so that there is electrical contact with each pin 33 through the adaptor 77. The gender adaptor 77 is sized and configured to be received, retained, and substantially surrounded by the socket 31. The gender adaptor 77 has a length approximately twice the depth of the socket 31 so that the adaptor 77 extends into the insulating housing 29 to a depth approximately one-half of the length of the gender adaptor 77. The width and height of the socket 31 are just slightly larger than the width and height of the insulating housing 79 so that when the contact adaptor 77 is inserted in the socket 31, there is a close-fit between the modular signal connector 27 and the adaptor 77.

The gender adaptor 77 has an insulating housing 79 and a plurality of pin receivers or passages 81 extending longitudinally therethrough. In the adaptor 77, the number of passages 81 will correspond to the number and geometrical arrangement of electrically conductive contact pins 33. Each passage 81 contains a conductive body 83 (see FIG. 11 ). The conductive body 83 may be a cylindrical body with two resilient spring ends 84. The conductive body 83 may, for example, be formed by stamping out a flat pattern and then shaping it into a cylinder. Many other variations can be used, such as but not limited to, a bifurcated tube or leaf spring inserts in each end of a cylinder. The insulating housing 79 is preferably fabricated from a flame-retardant plastic but any other suitably insulative material may be used. It is important that the insulating housing material be an electrical insulator in order to isolate signals carried by the pins from the signals carried by each adjacent pin.

Figure 11:
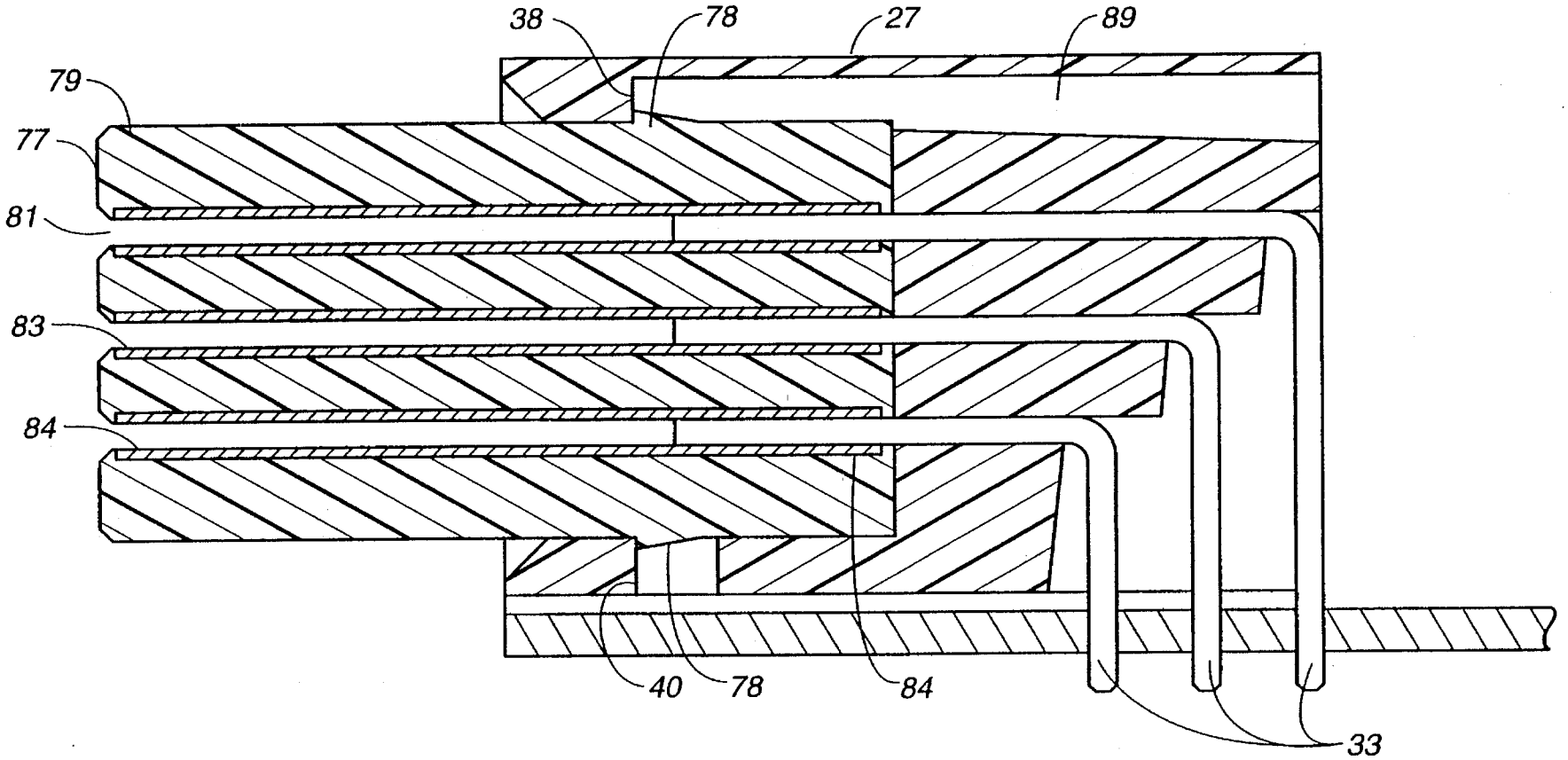
FIG. 11 is a cross-sectional view through a parallel signal connector module mated with a gender changing element.

With reference to FIG. 11, the contact adaptor 77 has a locking element 78 on at least one surface and preferably on both the top and bottom of the insulating housing 79. As noted above, the top and bottom sides of the socket 31 include a means for receiving and retaining the locking element 78 of the contact adaptor 77. For example, the latch channel or slot 40 extends outwardly away from the center of the socket 31. The slot 40 terminates internally in the insulating housing with an abutment surface and is generally rectangular in cross section. Moreover, each locking element 78 is shaped and positioned such that the locking element 85 can be received in a corresponding slot 40 of the insulating housing 27. For simplicity, the locking elements 78 of each side are preferably identical, however, it is within the scope of this invention that those projections may have different shapes and/or proportions, as desired.

Figure 12:
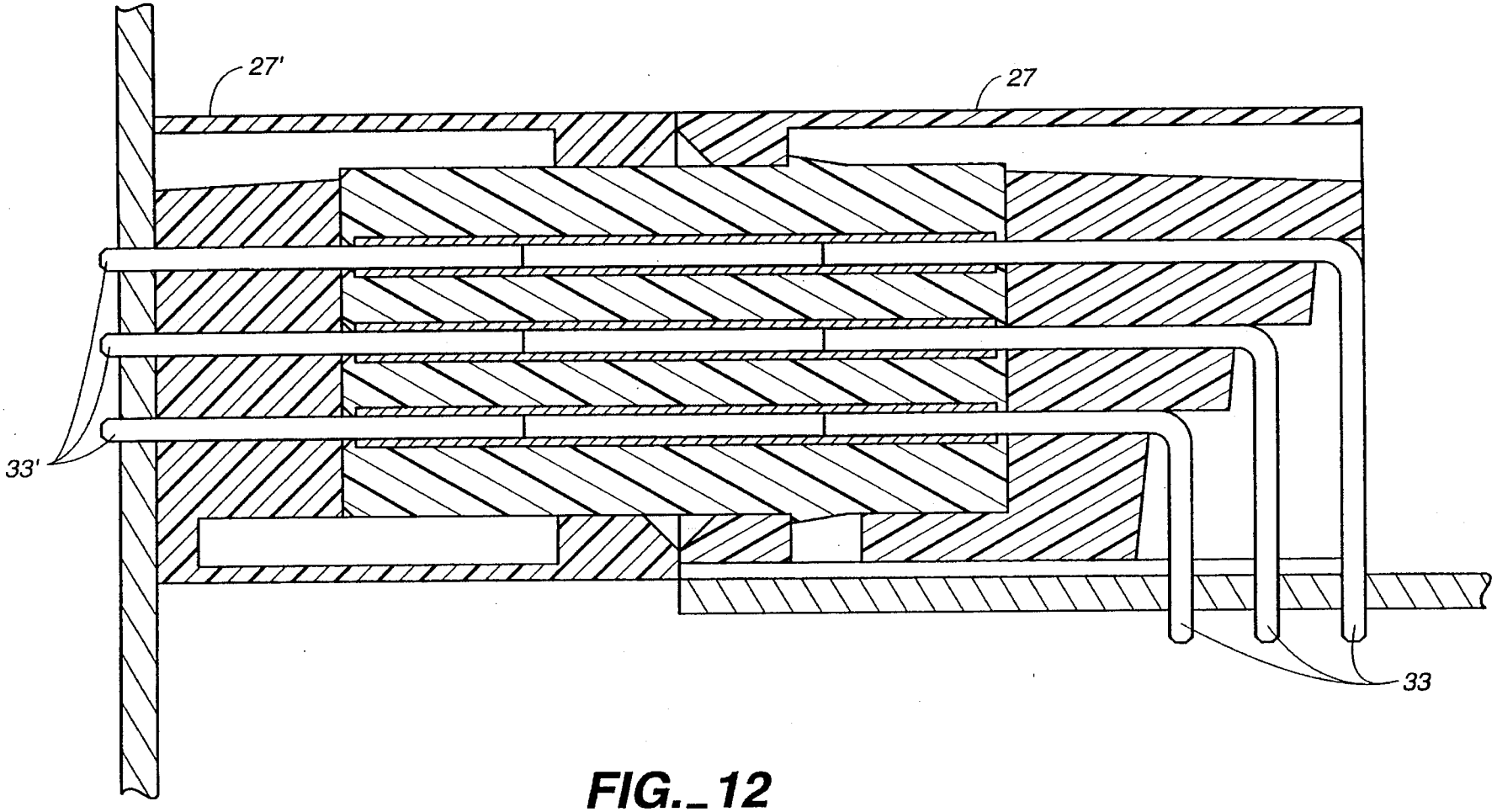
FIG. 12 is a cross-sectional view through a perpendicular mounting signal connector joined with a parallel mounting signal connector and the gender changing element.

As the gender adaptor 77 is inserted into the signal connector module 27, the locking elements 78 are lockingly received by slots 38, 40 on corresponding sides of the signal connector socket 31. Once the gender adaptor 77 is inserted in the signal connector 27 it can not be removed. Thus, the adaptor 77 effectively converts the female type signal connector module to a male type signal connector module. Moreover, when the male type signal connector module is removed from a female type module, cooperation of the locking elements 78 and the slots 38, 40 assures that the adaptor 77 remains with the male type module, thereby retaining its gender. The perpendicular mounting module signal connector 27' (FIG. 8) can be converted from a female type connector to a male type connector in the same way just described. Here again, when the signal connector 27' is mated with another signal connector 28 (for example as shown in FIG. 12), then subsequently disconnected from each other, the contact adaptor 77 will be retained in the signal connector 27'.

The hybrid modular connector system of the present invention can be adapted for coaxial cable or fiber optic termini as well. Coaxial cable couplers and gender changers can be housed in the insulating housing of the modules. Likewise, fiber optic couplers and gender changers can be incorporated into the housing of a module. Each interlocking module includes a female locking element on one side and a male locking element on the opposite side. The female and male locking elements are substantially identical on each of the modules. With this configuration, any number of fiber optic coupling modules, coaxial cable connecting modules, power connector modules, signal connector modules, spacer modules, and end flange modules can be used as may be required for a particular application.

The signal connection modules, as well as the power connector modules of this invention can be connected in various combinations. For example, as seen in FIG. 12, a parallel-mount signal connector is joined with a perpendicular-mount signal connector having a gender adaptor 77. Such an arrangement might be used, for example, to connect an edge of one printed circuit board with a second printed circuit board.

It will now be apparent that a modular electrical connector system has been described which overcomes the problems and deficiencies associated with prior devices. Moreover, it will now be apparent to those skilled in the art that various modifications, variations, substitutions, and equivalents exist for various elements of the invention but which do not materially depart from the spirit and scope of the invention. Accordingly, it is expressly intended that all such modifications, variations, substitutions and equivalents which fall within the spirit and scope of the invention as defined by the appended claims be embraced thereby.

What is claimed is:

1. A modular connector system for printed circuit boards, comprising:

a first modular connector comprising:

an insulating housing having a locking element on one side thereof and an opening; and an electrically conductive body in the opening, the electrically conductive body having at least one contact terminal for attaching to a printed circuit board; and a modular signal connector comprising:

an insulating housing having a cooperating locking element on one side thereof for permanently interlocking with the locking element of the first modular connector and an opening, the insulating housing defining a socket having at least one electrically conductive contact pin therein; and an electrically conductive body in the opening of the insulating housing of the modular signal connector, the electrically conductive body having at least one contact terminal for attaching to a printed circuit board; and an electrically conductive contact adaptor for inserting in the socket of the signal insulating housing.

2. The modular connector system of claim 1, further comprising an electrically conductive contact element for inserting in the opening of the insulating housing of the first modular connector to convert the first modular connector from a female connector to a male connector.

3. The modular connector system of claim 1 wherein the first modular connector is a power connector.

4. The modular connector system of claim 1, wherein the socket of the signal insulating housing has a locking element therein and the contact adaptor has a locking element for mating with the locking element of the socket of the signal insulating housing for permanently interlocking the contact adaptor to the modular signal connector.

5. The modular connector system of claim 1, wherein the contact adaptor is lockingly inserted in the socket of the signal insulating housing.

6. The modular connector system of claim 1, wherein:

the mating orientation of the opening in the insulating housing of the first modular connector is parallel to the plane of the printed circuit board; and the mating orientation of the opening in the insulating housing of the modular signal connector is parallel to the plane of the printed circuit board.

7. The modular connector system of claim 1, wherein:

the mating orientation of the opening in the insulating housing of the first modular connector is perpendicular to the plane of the printed circuit board; and the mating orientation of the opening in the insulating housing of the modular signal connector is perpendicular to the plane of the printed circuit board.

8. The modular connector system of claim 1, wherein the locking element of the first modular connector is a female dove-tail connection and the locking element of the modular signal connector is a male dove-tail connection.

9. The modular connector system of claim 1, further comprising a mounting flange having a locking element for permanently interlocking with the locking element of the first modular connector or the modular signal connector.

10. The modular connector system of claim 9, further comprising a spacer having a locking element for permanently interlocking with the locking element of the first modular connector, the modular signal connector, or mounting flange.

11. A method for assembling a modular connector system for printed circuit boards, comprising:

providing a first modular connector comprising:

an insulating housing having a locking element on one side thereof and an opening; and an electrically conductive body in the opening, the electrically conductive body having at least one contact terminal for attaching to a printed circuit board;

providing a modular signal connector comprising:

an insulating housing having a locking element on one side thereof for permanently interlocking with the locking element of the first modular connector and an opening, the insulating housing defining a socket having at least one electrically conductive contact pin therein; and an electrically conductive body in the opening of the insulating housing of the modular signal connector, the electrically conductive body having at least one contact terminal for attaching to a printed circuit board;

inserting an electrically conductive contact adaptor in the socket of the signal insulating housing for converting the modular signal connector from a female connector to a male connector; and interlocking the locking element of the first modular connector to the locking element of the modular signal connector.

12. The method of claim 11 wherein the locking element of the first modular connector is slidably interlocked with the locking element of the modular signal connector.

13. The method of claim 12 wherein the locking element of the first modular connector is a female dove-tail connection and the locking element of the modular signal connector is a male dove-tail connection.

14. The method of claim 11 further comprising inserting an electrically conductive contact element in the opening of the insulating housing of the first modular connector to convert the first modular connector from a female connector to a male connector.

15. The method of claim 14 wherein the electrically conductive contact element is lockingly inserted in the opening.

16. The method of claim 11 further comprising interlocking a mounting flange having a locking element with the locking element of the first modular connector or the modular signal connector.

17. The method of claim 16 further comprising interlocking a spacer having a locking element with the locking element of the first modular connector, the modular signal connector, or the mounting flange.

18. A modular connector system for printed circuit boards, comprising:

a first modular connector comprising:

an insulating housing having a locking element on one side thereof and an opening; and an electrically conductive body in the opening, the electrically conductive body having at least one contact terminal for attaching to a printed circuit board; and a second modular connector comprising:

an insulating housing having a cooperating locking element on one side thereof for permanently interlocking with the locking element of the first modular connector and an opening; and an electrically conductive body in the opening of the insulating housing of the second modular connector, the electrically conductive body having at least one contact terminal for attaching to a printed circuit board;

a mounting flange having a locking element for permanently interlocking with the locking element of the first modular connector or second modular connector; and a spacer having a locking element for permanently interlocking with the locking element of the first modular connector, second modular connector, or mounting flange.

19. A method for assembling a modular connector system for printed circuit boards, comprising:

providing a first modular connector comprising:

an insulating housing having a locking element on one side thereof and an opening; and an electrically conductive body in the opening, the electrically conductive body having at least one contact terminal for attaching to a printed circuit board;

providing a second modular connector comprising:

an insulating housing having a locking element on one side thereof for interlocking with the locking element of the first modular connector and an opening; and an electrically conductive body in the opening of the insulating housing of the second modular connector, the electrically conductive body having at least one contact terminal for attaching to a printed circuit board; and interlocking the locking element of the first modular connector to the locking element of the second modular connector;

interlocking a mounting flange having a locking element with the locking element of the first modular connector or the second modular connector; and interlocking a spacer having a locking element with the locking element of the first modular connector, the second modular connector, or the mounting flange.

20. A modular connector system for printed circuit boards, comprising:

a first modular connector comprising:

an insulating housing having a locking element on one side thereof and an opening; and an electrically conductive body in the opening, the electrically conductive body having at least one contact terminal for attaching to a printed circuit board;

a second modular connector comprising:

an insulating housing having a cooperating locking element on one side thereof for interlocking with the locking element of the first modular connector and an opening; and an electrically conductive body in the opening of the insulating housing of the second modular connector, the electrically conductive body having at least one contact terminal for attaching to a printed circuit board; and a spacer having a locking element for interlocking with the locking element of the first modular connector or the second modular connector.

21. The modular connector system of claim 20, further comprising an electrically conductive contact element for inserting in the opening of the insulating housing of the first modular connector to convert the first modular connector from a female connector to a male connector.

22. The modular connector system of claim 20, further comprising an electrically conductive contact element for inserting in the opening of the insulating housing of the second modular connector to convert the second modular connector from a female connector to a male connector.

23. The modular connector system of claim 20 wherein the first modular connector is a power connector and the second modular connector is a signal connector.

24. The modular connector system of claim 23, wherein the insulating housing of the modular signal connector defines a signal socket having at least one electrically conductive contact pin.

25. The modular connector system of claim 24, further comprising an electrically conductive contact adaptor for inserting in the signal socket for converting the modular signal connector from a female connector to a male connector.

26. The modular connector system of claim 25, wherein the electrically conductive contact adaptor, comprises a contact adaptor insulating housing having at least one pin receiver for receiving the at least one electrically conductive contact pin of the signal contact.

27. The modular connector system of claim 26, wherein the signal socket has a locking element therein and the contact adaptor insulating housing has a locking element for mating with the locking element of the signal socket for interlocking the contact adaptor insulating housing to the modular signal connector.

28. The modular connector system of claim 25, wherein the electrically conductive contact adaptor is lockingly inserted in the signal socket.

29. The modular connector system of claim 20, wherein:

the mating orientation of the opening in the insulating housing of the first modular connector is parallel to the plane of the printed circuit board; and the mating orientation of the opening in the insulating housing of the second modular connector is parallel to the plane of the printed circuit board.

30. The modular connector system of claim 20, wherein:

the mating orientation of the opening in the insulating housing of the first modular connector is perpendicular to the plane of the printed circuit board; and the mating orientation of the opening in the insulating housing of the second modular connector is perpendicular to the plane of the printed circuit board.

31. The modular connector system of claim 23, wherein the locking element of the modular power connector is a female dove-tail connection and the locking element of the modular signal connector is a male dove-tail connection.

32. The modular connector system of claim 20, further comprising a mounting flange having a locking element for interlocking with the locking element of the first modular connector or second modular connector.

* * * * *